US005568106A

United States Patent [19]

Fang et al.

[11] Patent Number: 5,568,106

[45] Date of Patent: Oct. 22, 1996

[54] TUNABLE MILLIMETER WAVE FILTER USING FERROMAGNETIC METAL FILMS

[76] Inventors: Ta-Ming Fang; Hoton How; Carmine Vittoria, all of Massachusetts Technological Laboratory 330 Pleasant St., Belmont, Mass. 02178

[21] Appl. No.: 222,468

[22] Filed: Apr. 4, 1994

[51] Int. Cl.[6] ..... H01P 1/20

[52] U.S. Cl. ..... 333/204; 333/205; 333/202

[58] Field of Search ..... 333/33, 204, 205, 333/246, 202

[56] References Cited

U.S. PATENT DOCUMENTS

| | | | |
|---|---|---|---|
| H432 | 2/1988 | Mariani et al. | 333/205 |
| 3,748,605 | 7/1973 | Baynham | 333/204 |
| 4,169,252 | 9/1979 | Moszkiewicz | 333/205 |
| 4,191,308 | 3/1980 | Tsutsumi et al. | 333/204 |
| 4,197,517 | 4/1980 | Vittoria | 333/205 |
| 4,636,756 | 1/1987 | Ito et al. | 333/205 |
| 4,853,660 | 8/1989 | Schloemann | 333/204 |
| 4,992,760 | 2/1991 | Takeda et al. | 333/202 |

*Primary Examiner*—Robert Pascal
*Assistant Examiner*—Darius Gambino
*Attorney, Agent, or Firm*—Devine, Millimet & Branch P.A.

[57] ABSTRACT

The present invention discloses a frequency tunable filter which includes an electromagnetic (E-M) wave propagation line which includes a microstrip and a ground plane in the substrate for transmitting a sequence of E-M signals via the propagation line. The E-M wave propagation line includes a frequency tuning mechanism, i.e., the magnetic layer, which is capable of utilizing a ferromagnetic anti-resonance frequency response to the E-M signals transmitted via the propagation line for controlling and frequency tuning the E-M signal transmission. In one of the preferred embodiments, the E-M wave propagation line includes a microstrip forming on the top surface of a dielectric or semiconductor substrate for receiving and transmitting the E-M signals and a ground plane forming on the bottom surface of the semiconductor substrate. And, the frequency tuning mechanism includes a ferromagnetic layer formed in the substrate between the microstrip and the ground plane.

12 Claims, 3 Drawing Sheets

TUNABLE MILLIMETER WAVE FILTER USING FERROMAGNETIC METAL FILMS

BACKGROUND OF THE INVENTION

1. Field of the Invention

This invention relates generally to the design and fabrication of frequency tunable millimeter wave (MMW) filters. More particularly, this invention relates to the design and fabrication processes of the frequency tunable microwave/millimeter wavelength (MMW) filters which utilize metallic magnetic thin films biased near ferromagnetic anti-resonance (FMAR) to achieve wide frequency-tuning range, low insertion loss, high isolation, fast response time and relative high power handling capability.

2. Description of the Prior Art

Conventional techniques of system design for radar transmission and reception are limited by the difficulty that frequency tunable filters are not commonly available. In order to eliminate the receiver images and to increase the amplifier efficiency, it is desirable to incorporate the frequency tunable filters in the radar transmission and reception systems. However, due to the conventional design approaches generally employed by those skilled in designing the microwave and millimeter wavelength (MMW) filters, the range achievable for those filters in frequency tuning is very limited.

In a conventional approach, the MMW filters are typically designed based on varying the capacitive or inductive loading of the resonators. When the design is based on the capacitive loading of the resonator, varactors are commonly used and the range of the frequency tuning is only a few percent of the transmission frequency. On the other hand, when the filter design is based on the inductive loading of the resonator, ferrite insulators are used which are generally in the form of polished spheres of single crystal yitrium iron garnet (YIG). The ferrite spheres are biased by a magnetic field and the transmission frequency is designed at ferromagnetic resonance (FMR). At FMR the insertion loss of the device is relatively high (>1 dB) and the frequency tuning range is normally limited by the spurious transmission due to the coupling of the high order magnetostatic modes. In either case, the range allowable for frequency tuning by implementing these MMW filters in a radar system are quite restrictive. Due to this limitation, higher quality of the transmitted images and greater efficiency of amplification for the radar systems thus become more difficult to achieve.

Due to the use of varactors and ferrite insulators, the conventional filter designs are subject to another limitation that the filters are only capable of being operated in low power applications. Due to the small amount of charge carriers available in the junctions, the varactors fabricated on semiconductor junctions which incorporate depletion layers are limited by low power levels generally below a few watts. Meanwhile, the spin-wave instabilities caused by the excitation of higher order magnetic waves in the ferrite insulators also limits the achievable power level in a frequency tunable filters. Application of the conventional frequency tunable filters to radar transmission is limited due to this intrinsic lower power characteristic.

Furthermore, with the varactors or ferrite insulators, the filters can not be conveniently fabricated and be compatible with the microwave planar technology. Due to this limit, the filters which employ varactors and ferrite insulator cannot take advantage of the mass-production capability of current microwave monolithic integrated circuit (MMIC) technology to produce frequency tuning filters in large quantity at low cost. Broad and economical applications of the filters are thus prevented due to these difficulties.

Therefore, there is still a demand in the art of MMW filter design and fabrication to provide a new technique in designing and fabricating an MMW filter which is able to achieve wide frequency-tuning range, low insertion loss, high isolation, fast response time and relative high power handling capability.

SUMMARY OF THE PRESENT INVENTION

It is therefore an object of the present invention to provide a new technique in MMW filter design and fabrication to overcome the aforementioned difficulties encountered in the prior art.

Specifically, it is an object of the present invention to provide a non-resonant frequency tunable band-pass filter by utilizing ferromagnetic metals biased at ferromagnetic anti-resonance (FMAR) such that the range of frequency tuning is expanded.

Another object of the present invention is to provide a non-resonant frequency tunable band-pass filter by utilizing ferromagnetic metals biased at ferromagnetic anti-resonance (FMAR) such that the insertion loss is decreased because the ferromagnetic metal is biased off-resonance.

Another object of the present invention is to provide a non-resonant frequency tunable band-pass filter by utilizing ferromagnetic metals biased at ferromagnetic anti-resonance (FMAR) such that it is suitable for operation at high power applications because the insertion loss is decreased.

Another object of the present invention is to provide a non-resonant frequency tunable band-pass filter by utilizing ferromagnetic metals biased at ferromagnetic anti-resonance (FMAR) such that the device fabrication process is compatible with the microwave planar technology.

Briefly, in a preferred embodiment, the present invention discloses a frequency tunable filter which includes an electromagnetic (E-M) wave propagation means for transmitting a sequence of E-M signals therein. The E-M wave propagation means includes a frequency tuning means is capable of utilizing a ferromagnetic anti-resonance frequency response to the E-M signals transmitted therein for controlling and frequency tuning the E-M signal transmission.

It is an advantage of the present invention that it provides a non-resonant frequency tunable band-pass filter by utilizing ferromagnetic metals biased at ferromagnetic anti-resonance (FMAR) such that the range of frequency tuning is expanded.

Another advantage of the present invention is that it provides a non-resonant frequency tunable band-pass filter by utilizing ferromagnetic metals biased at ferromagnetic anti-resonance (FMAR) such that the insertion loss is decreased because the ferromagnetic metal is biased off-resonance.

Another advantage of the present invention is that it provides a non-resonant frequency tunable band-pass filter by utilizing ferromagnetic metals biased at ferromagnetic anti-resonance (FMAR) such that it is suitable for operation at high power applications because the insertion loss is decreased.

Another advantage of the present invention is that it provides a non-resonant frequency tunable band-pass filter by utilizing ferromagnetic metals biased at ferromagnetic anti-resonance (FMAR) such that the device fabrication process is compatible with the microwave planar technology.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
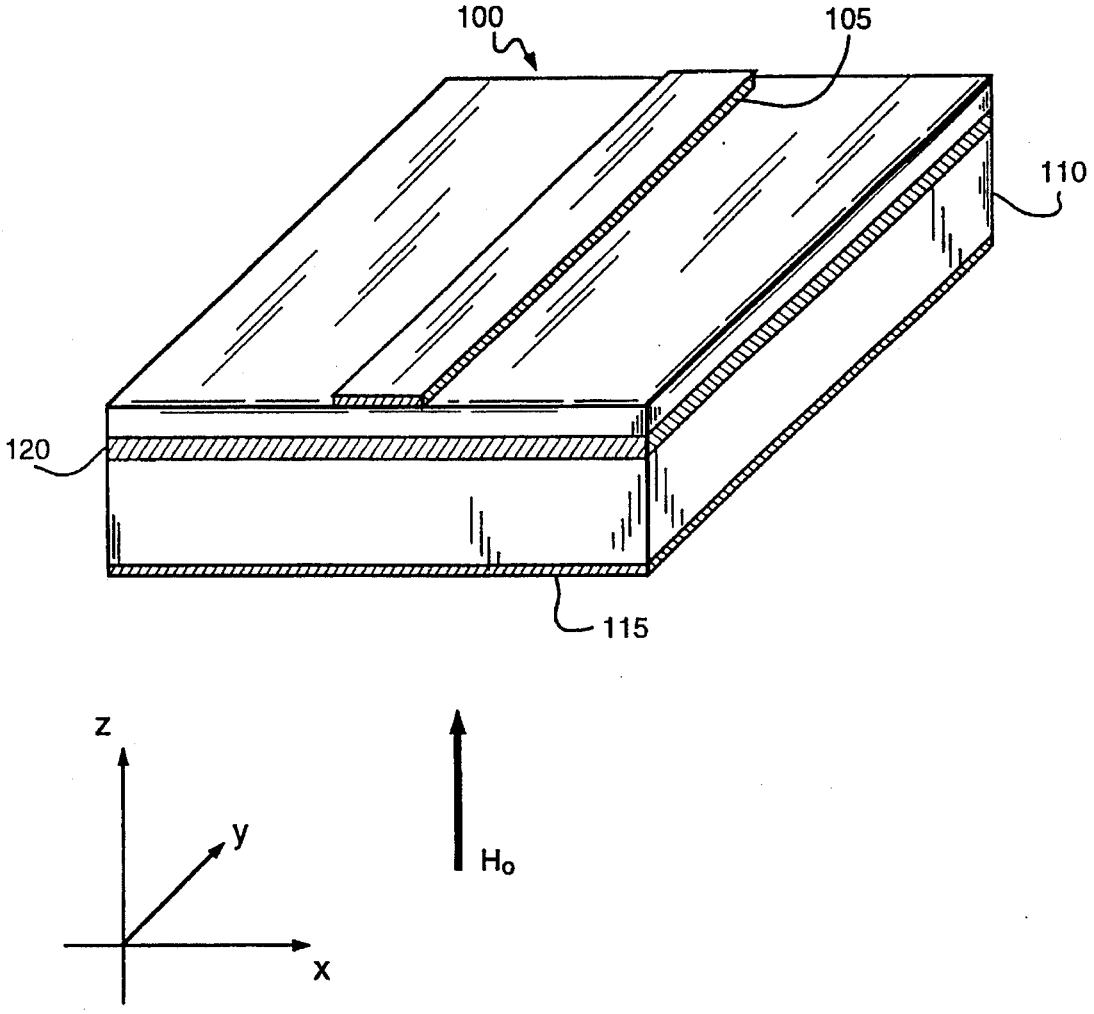
FIG. 1 is a partial perspective view of a frequency tunable filter of the present invention.

FIG. 1 shows a microwave/millimeter wavelength (MMW) filter 100 of the present invention. The MMW filter 100 is fabricated with a composite microstrip line 105 formed on a semiconductor substrate 110 which has a ground plane 115 preferably composed of a copper layer formed on the bottom surface of the substrate 110. A thin layer of magnetic metal film 120 of thickness d is formed between and in parallel to the microstrip 105 deposited on the top surface of the substrate 110 and the ground plane 115 at the bottom. A direct current (dc) magnetic field is applied perpendicular to the inserted magnetic layer 120, i.e., in the direction parallel to the Z-axis.

In absence of the magnetic layer 120, the characteristic impedance of the microstrip 105 is $Z_0$ ohms. When the magnetic layer 120 is biased away from the FMAR, the magnetic layer 120 interferes strongly with the wave propagation transmitted therein. The characteristic impedance of the microstrip line 105 is decreased with the interferences of the magnetic layer 120 and becomes much less than the original characteristic impedance $Z_0$. It generates impedance mismatch which will cause a reflection of the microwave/millimeter wave signals for transmission through the filter 100. Conversely, when the thin magnetic layer 120 is biased within the ferromagnetic anti-resonance (FMAR) frequency ranges, the skin depth within the magnetic layer 120 becomes substantially greater than the thickness of the layer 120. As a consequence, the impedance of the microstrip line 105 is changed to its original characteristic impedance $Z_0$ which matches the input signal feeder line (not shown) to the microstrip line 105. The incoming microwave/millimeter wave signals are transmitted through the filter 100 without being much affected by the presence of the magnetic layer 120. A band-pass filtering function is therefore achieved by this MMW filter 100 which has a bandpass bandwidth which is substantially equivalent to the linewidth of the FMAR of the magnetic layer 120.

The present invention thus discloses a preferred embodiment which comprises a frequency tunable filter 100 which includes an electromagnetic (E-M) wave propagation means, which includes the microstrip 105 and the ground plane 115 in the substrate 110, for transmitting a sequence of E-M signals therein. The E-M wave propagation means includes a frequency tuning means, i.e., the magnetic layer 120, which is capable of utilizing a ferromagnetic anti-resonance frequency response to the E-M signals transmitted therein for controlling and frequency tuning the E-M signal transmission. In one of the preferred embodiments, the E-M wave propagation means includes a microstrip 105 forming on the top surface of a dielectric or semiconductor substrate 110 for receiving and transmitting the E-M signals and a ground plane 115 forming on the bottom surface of the dielectric or semiconductor substrate 110. And, the frequency tuning means includes a ferromagnetic layer 120 formed in the substrate 110 between the microstrip 105 and the ground plane 115.

A method for fabricating a frequency tunable filter is also disclosed in this invention which comprises the steps of (a) forming an electromagnetic (E-M) wave propagation means by forming a microstrip 105 on the top surface of a dielectric or semiconductor substrate 110 for receiving and transmitting the E-M signals and a ground plane 115 forming on the bottom surface of the dielectric or semiconductor substrate 110; and (b) forming a frequency tuning means by forming a ferromagnetic layer 120 in the substrate 110 deposited between and in parallel to the microstrip 105 and the ground plane 115 wherein the ferromagnetic layer 120 being biased by a dc magnetic field perpendicular to the layer 120 which is capable of utilizing a ferromagnetic anti-resonance (FMAR) frequency response to the E-M signals transmitted therein for controlling and frequency tuning the E-M signal transmission. The method of fabricating the frequency tunable filter 100 as described above, wherein the step (a) in forming an electromagnetic (E-M) wave propagation means 105, and the step (b) in forming a frequency tuning means 120 are fabrication steps which can be performed by the use of monolithic microwave integrated circuit (MMIC) technology.

More insights and understanding of the characteristics to achieve better design of the frequency tunable filter 100 as described above can be accomplished through the knowledge that the ferromagnetic anti-resonance occurs for frequencies somewhat above the ferromagnetic resonance frequencies. At FMAR, the radio-frequency (rf) magnetic moment, $\underline{m}$, is out-of-phase with the driving field $\underline{h}$, so that:

$$\underline{b}=\underline{h}+4\pi\underline{m}=0 \quad (1)$$

$\underline{b}$=rf magnetic induction field. Under this condition, the dynamic permeability μ of the magnetic layer 120 is limited by the magnetic relaxation and is very small. On the other hand, the effective skin depth, which is limited only by the magnetic damping under this condition, is very large. The condition as represented by Equation (1) can be combined with the magnetic equations of motion defined by:

$$\underline{M}=\gamma\underline{M}\times\underline{H} \quad (2)$$

where $$\underline{H}=\underline{H}_0+\underline{h} \quad (3)$$

and where $\underline{M}$=total magnetic moment;

γ=the gyromagnetic ratio;

$\underline{H}$=total magnetic field;

$\underline{H}_0$=dc magnetic field;

which leads to the condition for FMAR:

$$\omega/\gamma=B_0H_{in}+4\pi M_s \quad (4)$$

where

ω=2πf=angular frequency;

$B_0$=dc magnetic induction;

$H_{in}$=the static internal magnetic field; and $4\pi M_s$=the saturation magnetization of the magnetic layer 120

From Equation (4), once the material for the magnetic layer 120 is selected, the frequency characteristics of the frequency tunable filter 100 can be determined. At FMAR, the magnetic layer 120 is characterized by a small permeability value μ which results in very large skin depth when the magnetic layer 120 is exposed to an rf excitation. The magnetic layer 120 appears to be transparent to the microwave or millimeter wave transmission. For this reason, the filter 100 becomes a bandpass filter which has bandwidth substantially equivalent to the linewidth of FMAR as defined by $\Delta H_{FMAR}$ which can be calculated as the following:

$$\Delta H_{FMAR}=0.3(4\pi M_s)\ [(\delta_s/d)\ (\Delta H/M_s)^{3/2}]^{1/2} \quad (5)$$

Where $\delta_s$=is the classical skin depth; and $$\delta=C/(2\pi\sigma\omega)^{1/2} \quad (6)$$

Where C is speed of light in vacuum and σ is the conductivity of the magnetic layer 120, and AH is the linewidth at FMR as defined by:

$$\Delta H=2(\lambda/\gamma)\ (\omega/\gamma M_s) \quad (7)$$

where

λ=the Landau-Lifshitz damping parameter.

The frequency tunable filter 100 as shown in FIG. 1 can therefore be designed by employing the bandpass characteristic of the magnetic layer 120 with a bandwidth defined by Equation (5).

The permeability value m of the magnetic layer 120 can be expressed as $$\mu=\mu_1-\mu_2^2/\mu_1 \quad (8)$$

where $$\mu_1=1+4\pi M_s H^*/(H^{*2}f^2/\gamma^2) \quad (9\text{-}1)$$

$$\mu_2=4\pi(M_s f/\gamma)/(H^{*2}f^2/\gamma^2) \quad (9\text{-}2)$$

and $$H^*=H_{in}+j\alpha f/\gamma$$

$$H_{in}=H_0-4\pi M_s$$

and α is the Gilbert damping constant. The effective permittivity value of the magnetic layer 120 is:

$$\epsilon=4\pi j\sigma/\omega \quad (10)$$

and σ is the conductivity of the magnetic layer 120.

From Equation (8), the functional dependence of the characteristic impedance Z and the wave propagation constant K of the composite microstrip line 110 can be expressed as:

$$Z=F_1(H_0, f, 4\pi M_s, \alpha, \epsilon_0, \sigma, d, d_1, d_2) \quad (11)$$

$$K=F_2(H_0, f, 4\pi M_s, \alpha, \epsilon_0, \sigma, d, d_1, d_2) \quad (12)$$

and $F_1$ and $F_2$ can be determined only through numerical calculations, such as finite difference or finite element methods. In Equations (11) and (12), $\epsilon_0$ denotes the dielectric constant of the substrate 110. by connecting the microstrip line 120 which has a length L to two feeder lines of characteristic impedance $Z_0$ normally has a value of fifty ohms, the reflection coefficient R at the input port and the transmission coefficient T at the output port can be calculated as:

$$R=-Y(E-1/E) \quad (13)$$

and $$T=-Y(X-1/X)exp(jK_0L) \quad (14)$$

where E, X, and Y are defined as:

$$E=exp(-jKL) \quad (15)$$

$$X=(Z_1-Z_0)/(Z_1+Z_0) \quad (16)$$

$$Y=[EX-(EX)^-]^{-1} \quad (17)$$

Figure 2:
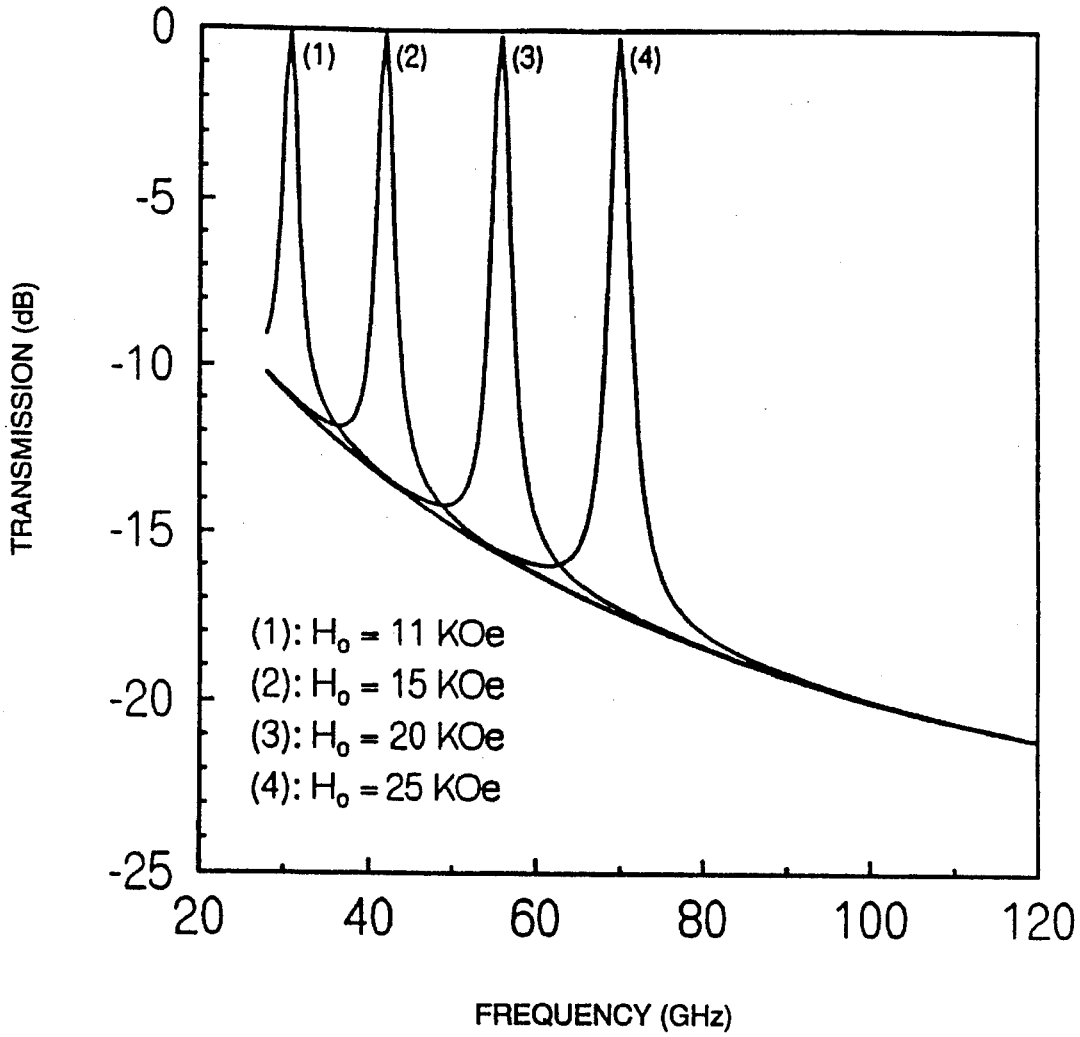
FIGS. 2 shows the wave propagation characteristics through the frequency tunable filter of the invention.

Here $K_0$ denotes the propagation constant in the feeder lines. FIG. 2 shows the transmission characteristics (in dB) of the microwave / millimeter waves (MMW) propagating through the filter 100 with the values of the filter dimensions and the parameters listed on FIG. 2. The calculations is performed by utilizing a finite difference method to obtain solution for Equations (11) and (12) and assuming that the permalloy is used as the magnetic layer 120 in the fabrication of the filter. The dielectric constant of the substrate 110 is $\epsilon_0$ which is set to a value of 5. And, $d_1$the depth between the microstrip 105 and the magnetic layer 120 is 0.05 mm, $d_2$, i.e., the depth between the magnetic layer 120 is 0.5 mm and the ground plane 115, and d, the thickness of the magnetic layer 120 is 10 μm. The width w and the length L of the microstrip 105 is w=0.885 mm and L=0.5 mm respectively. The magnetic layer 120 has a saturation magnetization $4\pi M_s$10 KG (permalloy), a ferromagnetic resonance linewidth ΔH=50 Oe (at 30 GHz), and a resistivity ρ=4.68 μΩ cm (permalloy). FIG. 2 shows that transmission of the MMW waves occurs at FMAR frequencies in the frequency tunable filter 100 with a bandwidth roughly equal to the FMAR linewidth. The frequency is tunable from 30 to 70 GHz with insertion loss less than 0.2 dB while isolation is larger than 10 dB and the frequency bandwidth is less than 2GHz. For a specific application, a ferromagnetic layer 120 composed of $Co_{74}Fe_6B_{15}Si_5$ thin film is used which posses nearly zero magnetostriction coefficients and exhibits very small magnetization saturation values. The operation characteristic of the filter 100, e.g., the isolations, can be further improved by increasing the length L of the microstrip 105 and decreasing the thickness d of the magnetic layer 120.

For a given design of a MMW filter 100, the transmission characteristic (in dB) as function of frequency can be determined by first computing the characteristic impedance $Z_0$ in the absence of the magnetic layer 120. The transmission frequency with the presence of the magnetic layer 120 can then be determined by the use of Equation (1), or more directly from Equation (8) applying Equation (9) by assuming that μ=0 to compute the transmission frequency $f_0$ which is a function of the dc magnetic field $H_0$. The transmission bandwidth can be obtained by computing the values of $\Delta HF_{MAR}$ from Equation (5). A numerical solution method is then used to determine the functional dependence relations as represented as $F_1$ and $F_2$ in Equations (11) and (12) The transmission characteristic in dB as a function of frequency can then be calculated through Equations (11) to (14) with numerical solutions for $F_1$ and $F_2$ available.

Figure 3:
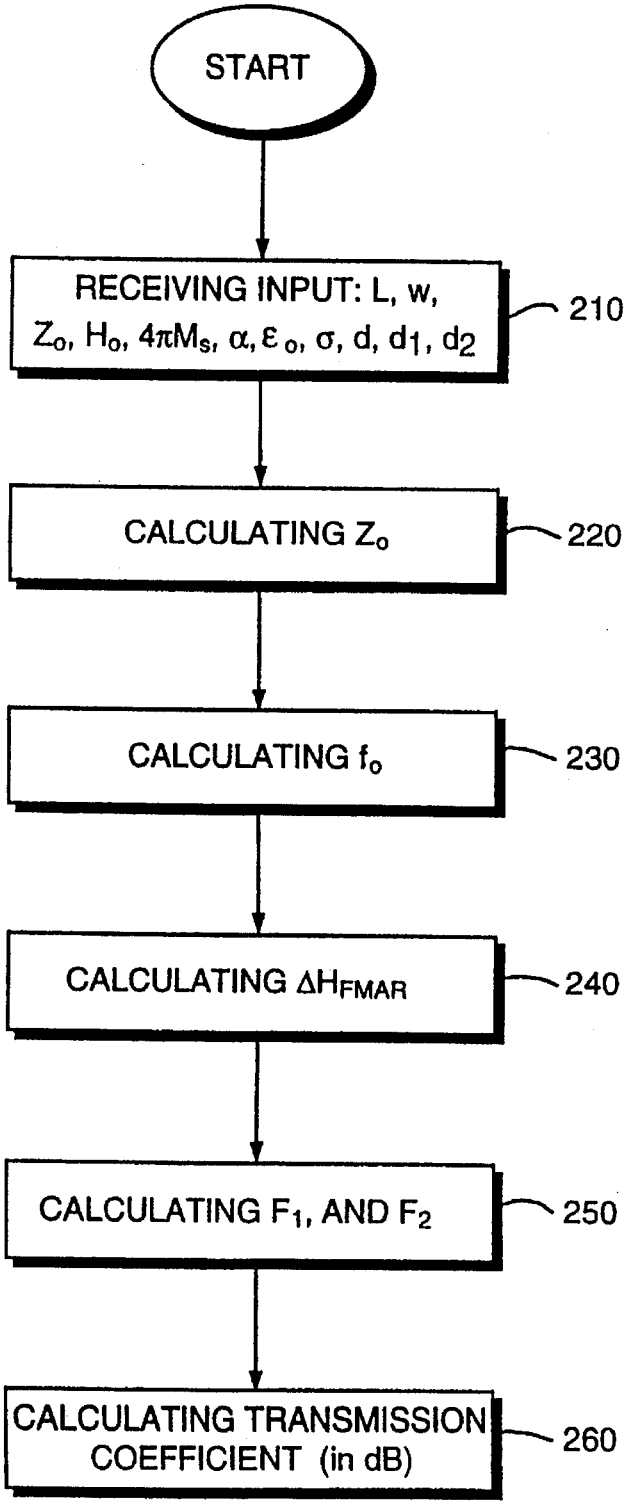
FIG. 3 is a flow chart showing the steps used in the method for designing and fabricating the frequency tunable filter of the present invention.

FIG. 3 shows, in a flow chart format, the steps described above which are used to determine the transmission characteristic (in dB) as a function of frequency. To begin the process, the design parameters of the filter 100 are received as input data in step 210. The characteristic impedance $Z_0$ in the absence of the magnetic layer 120 is calculated in step 220. The transmission frequency $f_0$ is then determined as a function of the dc magnetic field $H_0$ by the use of either Equation (1) or Equations (8) and (9) assuming $\mu=0$. (step 230) The transmission bandwidth is then calculated according to Equation (5) in step 240. The functional dependence relations, i.e., $F_1$ and $F_2$ in Equations (11) and (12) are then obtained by the use of a numerical solution method such as a finite difference solution method in step 250. The transmission characteristic in dB as a function of frequency is then calculated by the use of Equations (11) to (14) in step 260 by using the numerical solutions obtained in step 250 for $F_1$ and $F_2$.

The frequency tunable filter 100 as disclosed in this invention thus provides a frequency tunable filter 100 forming a bandpass filter with a bandwidth substantially equivalent to the linewidth of the FMAR as defined by Equation (5). Additionally, the frequency tunable filter 100 as disclosed in this invention provides a frequency tunable filter 100 which has a frequency tuning range extending substantially from thirty (30) to one-hundred-and-twenty (120) giga-Hertz (GHz) as that shown in FIG. 2.

The present invention thus provides a new technique in MMW filter design and fabrication whereby the difficulties encountered in the prior art are resolved. Specifically, the present invention provides a non-resonant frequency tunable band-pass filter by utilizing ferromagnetic metals biased at ferromagnetic anti-resonance (FMAR) such that the range of frequency tuning is greatly expanded. The present invention also provides a non-resonant frequency tunable band-pass filter by utilizing ferromagnetic metals biased at ferromagnetic anti-resonance (FMAR) such that the insertion loss is decreased because the ferromagnetic metal is biased off-resonance. The filter of the present invention is also suitable for operation at high power applications because the insertion loss is now decreased. Furthermore, the device fabrication process of the non-resonant frequency tunable band-pass filter as disclosed in the present invention is compatible with the microwave planar technology. The advantage of modern MMIC fabrication technology can be fully utilized to mass produce the frequency tunable filters of the present invention in large quantity at low cost to enhance broad and economical applications of such filters.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An anti-resonant frequency tunable band-pass filter comprising:

an electro-magnetic (E-M) wave propagation means for transmitting a sequence of E-M signals therein;

a magnetic biasing means;

said E-M wave propagation means comprising a ferromagnetic anti-resonance (FMAR) frequency tuning means wherein said magnetic biasing means biases said E-M wave propagation means substantially at a ferromagnetic anti-resonance (FMAR) frequency of said FMAR frequency tuning means for controlling and frequency tuning said filter.

2. The anti-resonant frequency tunable band-pass filter of claim 1 wherein;

said ferromagnetic anti-resonance (FMAR) frequency tuning means is a magnetic layer biased by said magnetic biasing means.

3. The anti-resonant frequency tunable band-pass filter of claim 2 wherein:

said E-M wave propagation means comprises a micro strip formed on a top surface of a dielectric or semiconductor substrate for receiving and transmitting said E-M signals and a ground plane formed on a bottom surface of said dielectric or semiconductor substrate; and said magnetic layer biased by said magnetic biasing means comprises a ferromagnetic film formed in said substrate deposited between and in parallel to said microstrip and said ground plane.

4. The anti-resonant frequency tunable band-pass filter of claim 3 wherein:

said magnetic biasing means applies said biasing magnetic field perpendicular to said ferromagnetic layer.

5. An anti-resonant frequency tunable band-pass filter comprising:

an electromagnetic (E-M) wave propagation means for transmitting a sequence of E-M signals therein, said E-M wave propagation means comprising a microstrip formed on a top surface of a dielectric or semiconductor substrate for receiving and transmitting said E-M signals and a ground plane formed on a bottom surface thereof;

a magnetic biasing means;

said E-M wave propagation means further comprising a ferromagnetic anti-resonance (FMAR) frequency tuning means which comprises a magnetic layer disposed intermediate and parallel to said microstrip and said ground plane wherein said magnetic biasing means applies a biasing magnetic field perpendicular to said magnetic layer substantially at a ferromagnetic anti-resonance (FMAR) frequency of said FMAR frequency tuning means for controlling and frequency tuning said transmission of said E-M signals.

6. The anti-resonant frequency tunable band-pass filter of claim 5 wherein said frequency tunable band-pass filter has a bandwith substantially equivalent to the line width of said FMAR $\Delta H_{FMAR}$ as defined by $$\Delta H_{FMAR}=0.3(4\pi M_s)[\delta_s/d)(\Delta H/M_s)^{3/2}$$

where $\delta_s$= the classical skin depth of said ferromagnetic film; and $$\delta=C(2\pi\sigma\omega)^{1/2}$$

where C is the speed of light in a vacuum and $\sigma$ is the conductivity of said magnetic film, and $\Delta H$ is the line width at a ferromagnetic resonance (FMAR) as defined by:

$$\Delta H=2(\lambda\gamma)(\omega/\gamma M_s)$$

where $\lambda$= the Landau-Lifshitz damping parameter.

7. The anti-resonant frequency tunable band-pass filter of claim 6 wherein:

said frequency tunable band-pass filter has a frequency tuning range extending substantially from thirty (30) to one-hundred-and-twenty (120) giga-Hertz (GHz).

8. A method of fabricating an anti-resonant frequency tunable band-pass filter comprising the steps of:

(a) forming an electromagnetic (E-M) wave propagation means for transmitting a sequence of E-M signals therein;

(b) forming a ferromagnetic anti-resonance (FMAR) frequency tuning means characterized by a ferromagnetic anti-resonance (FMAR) frequency response to said E-M signals transmitted therein; and (c) applying a biasing magnetic field to said ferromagnetic anti-resonance (FMAR) frequency tuning means substantially at said ferromagnetic anti-resonance (FMAR) frequency of said FMAR frequency tuning means for controlling and frequency tuning said E-M signal transmission.

9. The method of fabricating the anti-resonant frequency tunable band-pass filter of claim 7 wherein:

said step (a) in forming a ferromagnetic anti-resonance (FMAR) frequency tuning means is a step of forming a magnetic layer.

10. The anti-resonant frequency tunable band-pass filter of claim 8 wherein:

said step (a) in forming an electromagnetic (E-M) wave propagation means is a step of forming a microstrip on a top surface of a dielectric or semiconductor substrate for receiving and transmitting said E-M signals and forming a ground plane on a bottom surface of said dielectric or semiconductor substrate; and said step (b) in forming a ferromagnetic anti-resonance (FMAR) frequency tuning means is a step of forming a ferromagnetic film in said substrate deposited between and in parallel to said microstrip and said ground plane.

11. An anti-resonant frequency tunable band-pass filter comprising the steps of:

(a) forming an electromagnetic (E-M) wave propagation means by forming a microstrip on a top surface of a dielectric or semiconductor substrate for receiving and transmitting E-M signals and forming a ground plane on a bottom surface of said dielectric or semiconductor substrate; and (b) forming a ferromagnetic anti-resonance (FMAR) frequency tuning means by forming a ferromagnetic film in said substrate deposited between and in parallel to said microstrip and said ground plane wherein a biasing magnetic field is applied to said FMAR frequency tuning means at substantially a ferromagnetic anti-resonance (FMAR) of said ferromagnetic layer for controlling and frequency tuning said E-M signal transmission.

12. The anti-resonant frequency tunable band-pass filter of claim 10 wherein:

said step (a) in forming an electromagnetic (E-M) wave propagation means, and said step (b) in forming a ferromagnetic anti-resonance (FMAR) frequency tuning means are fabrication steps performed by the use of monolithic microwave integrated circuit (MMIC) technology.

* * * * *